US007654213B1

(12) United States Patent
Marolda

(10) Patent No.: US 7,654,213 B1
(45) Date of Patent: Feb. 2, 2010

(54) NORMAL BELT CAPSTAN ASSEMBLY

(75) Inventor: Victor J. Marolda, Salem, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 727 days.

(21) Appl. No.: 11/499,975

(22) Filed: Jul. 25, 2006

(51) Int. Cl.
*B63B 21/56* (2006.01)
*B63B 21/66* (2006.01)
*F16G 1/28* (2006.01)
*F16G 5/20* (2006.01)

(52) U.S. Cl. ..... 114/244; 114/253; 254/333; 226/171; 474/252

(58) Field of Classification Search ..... 114/242, 114/244, 253, 254, 312, 326, 328; 254/265, 254/333; 226/170–172; 474/100, 164, 249–252; 367/15, 19, 20; 405/166–168.4
See application file for complete search history.

(56) References Cited

U.S. PATENT DOCUMENTS 3,216,636 A * 11/1965 Kothe ..... 226/1
3,329,406 A * 7/1967 Flair ..... 226/171
4,217,066 A * 8/1980 Gunther ..... 405/185
4,455,961 A * 6/1984 Hansen et al. ..... 114/254
5,199,659 A * 4/1993 Zibilich, Jr. ..... 242/470
5,263,431 A * 11/1993 Wood ..... 114/254
5,339,762 A * 8/1994 Waclawik et al. ..... 114/312
6,719,275 B1 * 4/2004 Waterson ..... 254/333
7,252,046 B1 * 8/2007 Ead et al. ..... 114/254

* cited by examiner

*Primary Examiner*—Ajay Vasudeva
(74) *Attorney, Agent, or Firm*—James M. Kasischke; Michael P. Stanley; Jean-Paul A. Nasser

(57) ABSTRACT

A normal belt capstan assembly for arrays towed by vessels includes a drive wheel mounted on the vessel and adapted to deploy and discharge an array. The drive wheel has a continuous groove throughout an outer edge thereof with opposed rims on either side of the groove. The assembly further includes a normal belt mounted on a plurality of rollers and disposed along a portion of the periphery of the drive wheel, the belt having a continuous central groove formed in a surface facing the drive wheel. The combined drive wheel groove and central groove are adapted to receive the array and termination module, and a retaining groove on either side of the central groove are adapted for receiving the drive wheel rims. The normal belt provides a normal force to the array and termination module.

5 Claims, 3 Drawing Sheets

NORMAL BELT CAPSTAN ASSEMBLY

STATEMENT OF GOVERNMENT INTEREST

The invention described herein may be manufactured and used by or for the Government of the United States of America for Governmental purposes without payment of any royalties thereon or therefor.

BACKGROUND OF THE INVENTION

1. Field of the Invention

The invention relates to underwater arrays towed by submarines, and is directed more particularly to a normal belt capstan assembly for moving an array from a stowed location inboard of the submarine to a trailing condition outboard of the submarine, and for retrieving the array.

2. Description of the Prior Art

Underwater arrays 10 (FIG. 1) typically include a series of listening devices 12 mounted on a thin elongated cable 14. When not in use, the array is wound on a spool mounted on the submarine 16. When deployment of the array is in order, a capstan assembly, including a drive wheel and a number of spring-loaded rollers, is used to feed the array into the sea 18. The drive wheel and the rollers pinch the array and drive the array either onboard for storage or outboard for deployment.

The capstan assembly currently in use includes some seventeen spring-loaded rollers. Each roller applies about 15-20 pounds of force on the array and thereby on the drive wheel. The spring-loaded rollers maintain pressure on the array, and thereby the drive wheel, throughout operation of the capstan assembly. The capstan assembly is extremely expensive, 1-4 million dollars, depending upon the size of the assembly. The life spans of the current assemblies are relatively short, and the maintenance thereof requires about two man-days, a critical alignment exercise, and about $300 in consumable parts, per year.

Each array includes an array "termination", an enlarged distal end portion of the array. Inasmuch as the termination portion of the array is of substantially larger diameter than the remainder of the array, and is of greater length than the array sensors, passage of the array termination through the capstan assembly is often problematic.

Thus, there is a need for an improved capstan assembly for deploying and retrieving underwater arrays, which assembly is more reliable, less expensive to buy and maintain, of greater life expectancy, and better able to handle array terminations without damage to the assembly or to the terminations.

SUMMARY OF THE INVENTION

An object of the invention is, therefore, to provide a capstan and normal belt assembly for deploying and retrieving underwater arrays, which assembly is more reliable, less expensive to purchase and maintain, of better life expectancy, and better able to accommodate array terminations without damage to the assembly or to the terminations.

With the above and other objects in view, a feature of the invention is the provision of a capstan and normal belt assembly for underwater arrays towed by marine vessels. The capstan assembly includes a drive wheel mounted on the vessel and adapted to rotatably receive and discharge an array, the drive wheel having a continuous groove throughout a peripheral portion thereof, the groove and a peripheral portion of the drive wheel forming opposed rims, the drive wheel groove being adapted to receive the array and a termination module fixed to the array. The capstan assembly further includes a belt mounted on a plurality of rollers and disposed along a portion of the periphery of the drive wheel, the belt having in a surface facing the drive wheel a continuous central groove adapted to receive the array and termination module, and a retaining groove on either side of the central groove for receiving the drive wheel rims. Upon rotation of the drive wheel to pay out the array, the belt moves with the drive wheel and the termination module is moved therebetween in the belt groove and impinges on the belt. The belt is separable from the drive wheel to provide for the termination module to ride around the drive wheel when exiting the vessel. Thereafter, the array moves between the drive wheel and the belt and impinges on the drive wheel, the belt and the drive wheel being in contact with each other to enclose the array in the belt groove and the drive wheel groove.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 2:
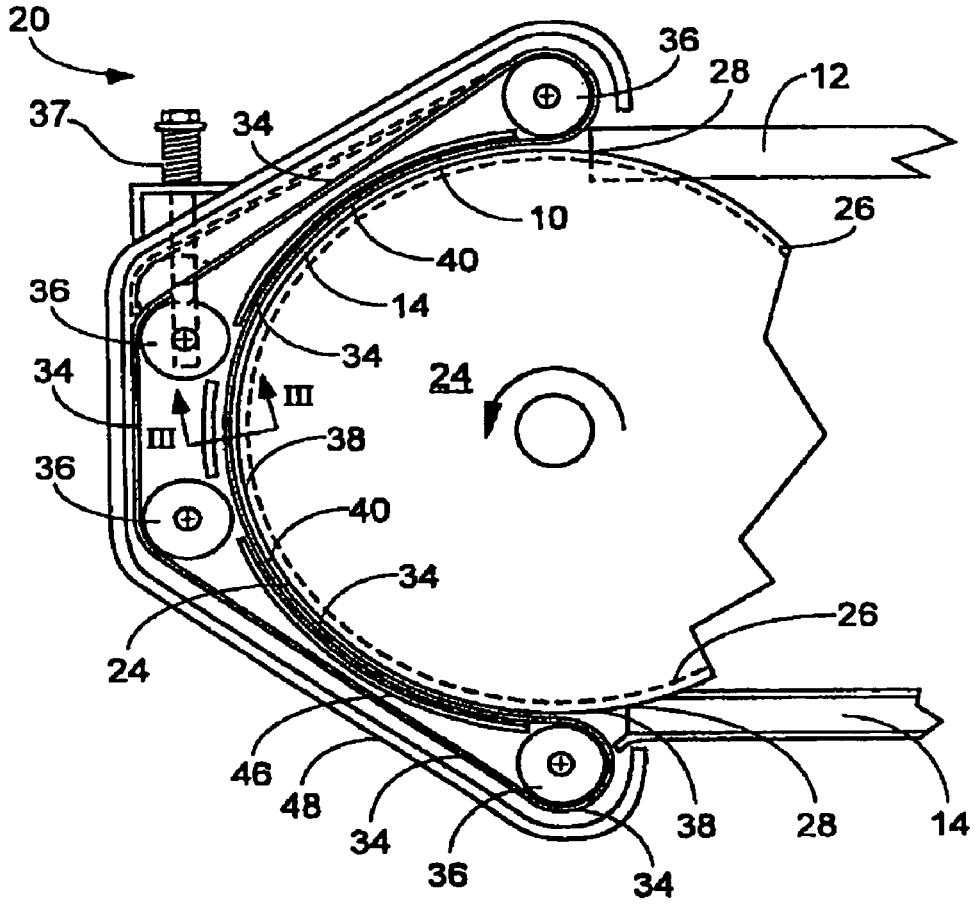
FIG. 2 is a plan view of one form of normal belt capstan assembly illustrative of an embodiment of the invention.

Referring to FIG. 2, it will be seen that a capstan and normal belt assembly 20 for underwater arrays 10 towed by submarines 16 includes a rotatable drive wheel 24 mounted on the submarine. The drive wheel 24 is adapted to rotatably receive and discharge the array 10 through a guide tube 25.

Figure 1:
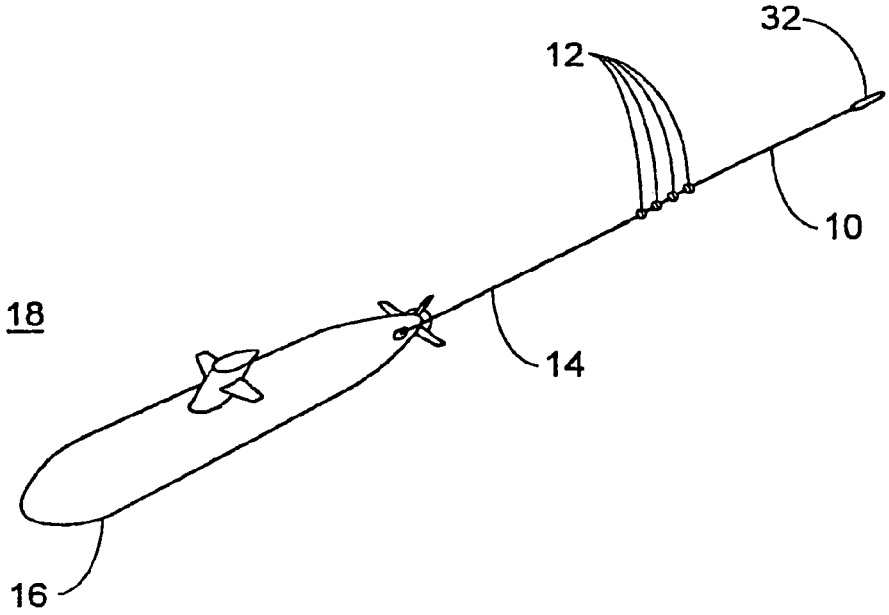
FIG. 1 is a diagrammatic illustration of a marine vessel and a towed array, including a termination module portion of the towed array.

The capstan assembly drive wheel 24 is provided with a continuous groove 26 throughout a peripheral portion 28 thereof. The drive wheel groove 26 and the peripheral portion 28 of the drive wheel 24 form opposed rims 22. The drive wheel groove 26 is adapted to receive the array 10 including sensor 12, cable 14 and a termination module 32 (FIG. 1) fixed to the array.

The capstan assembly 20 further includes a normal belt 34 mounted on four rollers 36 and disposed along a portion 38 of the periphery of the drive wheel 24. The belt 34 is provided with a surface 40 facing the drive wheel 24. In the preferred embodiment, belt 34 is not powered and merely acts to retain array 10, sensor 12, cable 14 and termination module 32 in contact with drive wheel 24.

Figure 3:
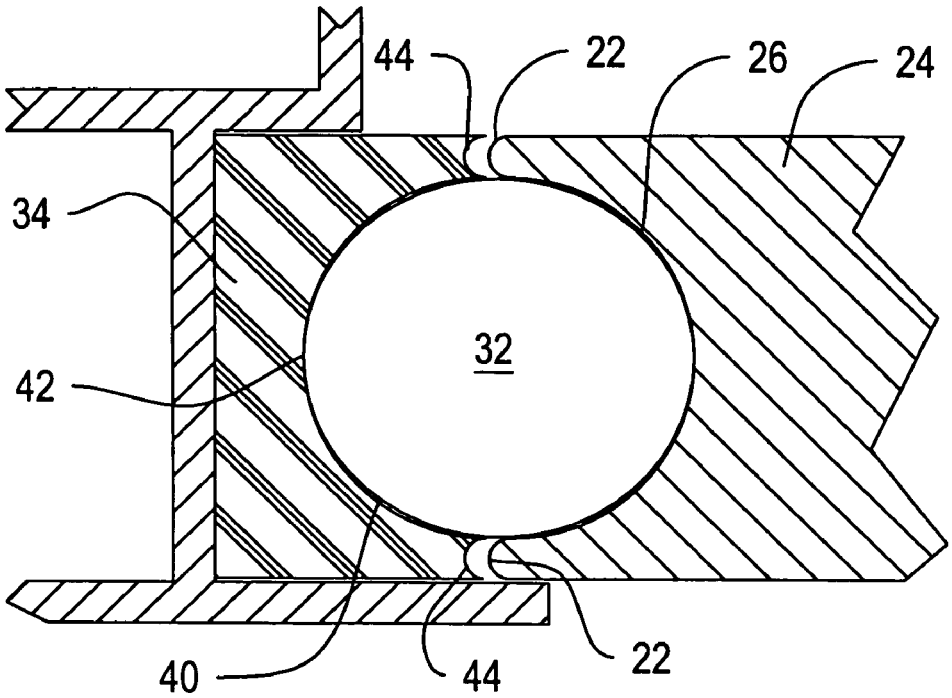
FIG. 3 is a diagrammatic sectional view taken along line of FIG. 2 and illustrating the interaction of the drive wheel, the belt, and the array termination module.
Figure 4:
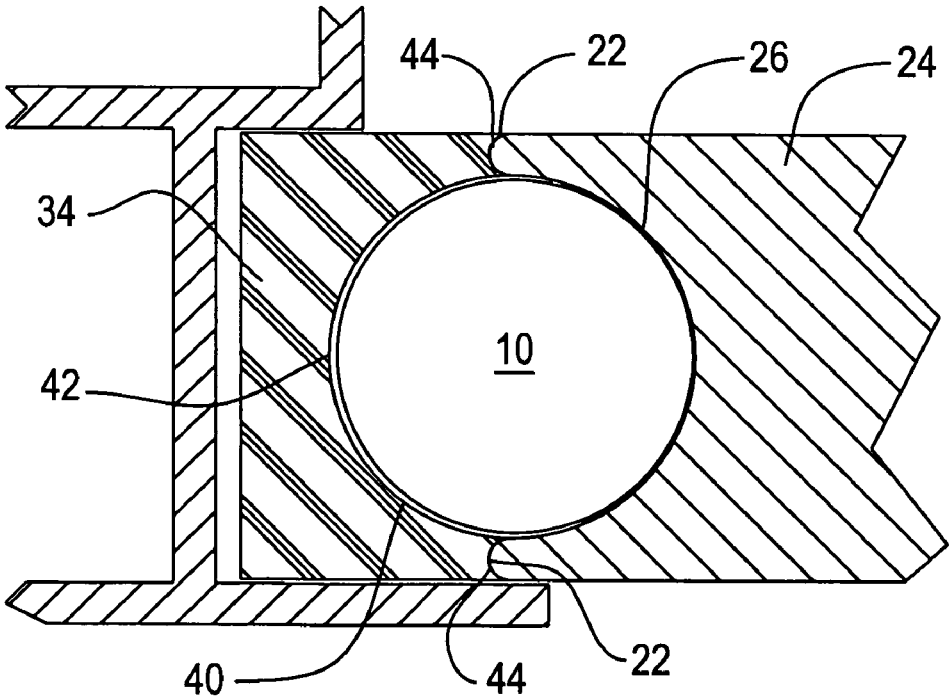
FIG. 4 is similar to FIG. 3, but illustrating the interaction of the drive wheel, the belt, and the array sensors.

Referring now to FIG. 3 and FIG. 4, rollers 36 can be biased towards drive wheel 24 by springs such as shown typically at 37. The surface 40 is provided with a continuous central groove 42 adapted to receive the array listening devices 12 and the termination module 32 (FIG. 3) which have a slightly larger diameter. The belt 34 is further provided with a retaining groove 44 on either side of the central groove 42 for receiving the drive wheel rims 22 (FIG. 4).

Upon rotation of the drive wheel 24 to pay out the array 10, the belt 34 moves with the drive wheel and the termination module 32 is moved therebetween in the belt central groove 42 and the drive wheel peripheral groove 26. The termination module 32 has a larger diameter than that defined by central groove 42 and continuous groove 26. As a result, module 32 impinges on the belt 34 as the module 32 moves around the drive wheel 24. Belt 34 provides a normal retaining force that acts to keep the termination module 32 against the drive wheel 24. This allows the termination module 32 to be pushed out the guide tube 25 to the aft of submarine 16.

Thereafter, as shown in FIG. 4, the array 10 has a smaller diameter than that defined by the grooves in drive wheel 24 and belt 34. The array 10 moves between the drive wheel 24 and the belt 34 and impinges on the drive wheel by virtue of the sea drag on the array. The belt 34 and the drive wheel 24 are in contact with each other, with the drive wheel rims 22 engaged in the belt retaining groves 44 to enclose the array in the belt central groove 42 and the drive wheel groove 26. Normal belt 34 does not apply force on array 10 unless array 10 has a larger diameter or is subjected to a force pushing array 10 radially outward from drive wheel 24. The normal belt 34 is protected by an inner shield 46 and an outer guard 48. Upon reversal of the drive wheel, the drive wheel 24 and belt 34 operate to draw in the array 10 and the termination module 32.

In view of the relatively few moving parts, including only four spring-loaded rollers, and the relatively easy passage of the termination module through the assembly, the normal belt capstan assembly provides a reliable, inexpensive, easily maintained assembly for paying out and drawing in an underwater array.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A normal belt capstan assembly for arrays towed by marine vessels, the assembly comprising:

a drive wheel mounted on the vessel and adapted to rotatably receive and discharge an array, said drive wheel having a continuous groove throughout a peripheral portion thereof, the drive wheel groove and a peripheral portion of said drive wheel forming opposed rims, the drive wheel groove being adapted to receive the array and a termination module portion of the array;

a plurality of rollers positioned radially about the drive wheel; and a normal belt mounted on the plurality of rollers and disposed along a portion of the periphery of said drive wheel, said belt having in a surface facing said drive wheel a continuous central groove adapted to receive the array and termination module, and a retaining groove on either side of the central groove for receiving the drive wheel rims;

wherein upon rotation of said drive wheel to pay out the array, said belt moves with said drive wheel and the termination module is moved therebetween in the belt central groove and the drive wheel peripheral groove and impinges on said belt, said belt being separable from said drive wheel to provide for the termination module to ride around said drive wheel to exit the vessel; and wherein thereafter the array moves between said drive wheel and said belt and impinges on said drive wheel, said belt and said drive wheel being in contact with each other to enclose the array in the belt central groove and the drive wheel peripheral groove.

2. The normal belt capstan assembly in accordance with claim 1 wherein when said belt and said drive wheel are in contact with each other, the drive wheel rims are engaged in the belt retaining grooves.

3. The normal belt capstan assembly in accordance with claim 2 wherein when said belt and said drive wheel are separated, the drive wheel rims are disengaged from and separated from the belt retaining grooves.

4. The normal belt capstan assembly in accordance with claim 1 wherein the plurality of rollers comprises four rollers.

5. The normal belt assembly in accordance with claim 4 wherein the rollers are radially biased toward said drive wheel to retain said normal belt in position with respect thereto.

* * * * *